United States Patent [19]

Thomas

[11] Patent Number: 4,785,490

[45] Date of Patent: Nov. 22, 1988

[54] DEVICE FOR CLEANING GOLF SHOE SPIKES

[76] Inventor: Everett H. Thomas, 332 North Lyon St., Space 58, Hemet, Calif. 92343

[21] Appl. No.: 28,123

[22] Filed: Mar. 19, 1987

[51] Int. Cl.[4] ..... A47L 13/02

[52] U.S. Cl. ..... 15/237; 15/239; 15/216

[58] Field of Search ..... 15/237, 238, 239, 240, 15/216, 112

[56] References Cited

U.S. PATENT DOCUMENTS

| | | | |
|---|---|---|---|
| 832,545 | 10/1906 | Gillett | 15/239 |
| 865,180 | 9/1907 | Horner | 15/239 |
| 1,153,698 | 9/1915 | Natterer | 15/239 |
| 2,887,713 | 5/1959 | Clark | 15/237 |
| 2,946,077 | 7/1960 | Dyer | 15/238 |
| 3,028,617 | 4/1962 | Racina | 15/237 |
| 3,789,453 | 2/1974 | Curtis | 15/237 |
| 4,571,767 | 2/1986 | Dangler | 15/112 |

*Primary Examiner*—Harvey C. Hornsby
*Assistant Examiner*—J. Dwight Poffenberger, Jr.

[57] ABSTRACT

This invention comprises a plurality of side by side chains mounted on a base, so that golf shoe spikes may be combed therethrough.

1 Claim, 1 Drawing Sheet

DEVICE FOR CLEANING GOLF SHOE SPIKES

BACKGROUND OF THE INVENTION

1. Field of the Invention

This invention relates generally to shoe cleat cleaning devices. More specifically, it relates to an implement for cleaning off mud and dirt from golf shoe spikes.

2. Description of Prior Art

It is well known that sometimes the underside of a golf shoe becomes heavily caked with mud and dirt, that becomes packed around the shoe spikes, so that it is difficult to remove with the use of a scraper digging between the spikes. This is a time-consuming chore, which may easily soil a person's hands. Therefore numerous stationary shoe cleaning devices have been developed in the past, against which the golf player can rub his shoes, while they still are on his feet. However, all these devices are made with bristle brushes, so that the bristles, get between the spikes to clean out the packed mud, which, in a short time, wears down the brush bristles and clogs between them, so that the brush soon loses its ability to accomplish its task of spike cleaning, while the packed mud on the device makes the device useless. Accordingly, the players stepping up to the device with the intention of cleaning their shoes, soon, in disgust, start to kick against it in hope of removing the mud from shoes, which thus breaks off more bristles from the brush. Such worn device, damaged and packed hard with debris, is accordingly now in want of an improvement.

SUMMARY OF THE INVENTION

Therefore, it is a principal object of the present invention to provide a device for cleaning packed mud and dirt off golf shoe spikes efficiently.

Another object is to provide a device for cleaning golf shoe spikes, that accomplishes the task quickly and easily by simply scraping the shoe thereacross, and which action does not wear out or clog the device, because the scraping action of the spikes sweeps the mud debris off the floor of the device, which thus is self-cleaning.

Other objects are to provide a device for cleaning golf shoes which is simple in construction, while being made of steel so as to be durable.

These, and other objects, will be readily evident, upon a study of the following Specification and the accompanying Drawing.

DETAILED DESCRIPTION

Figure 1:
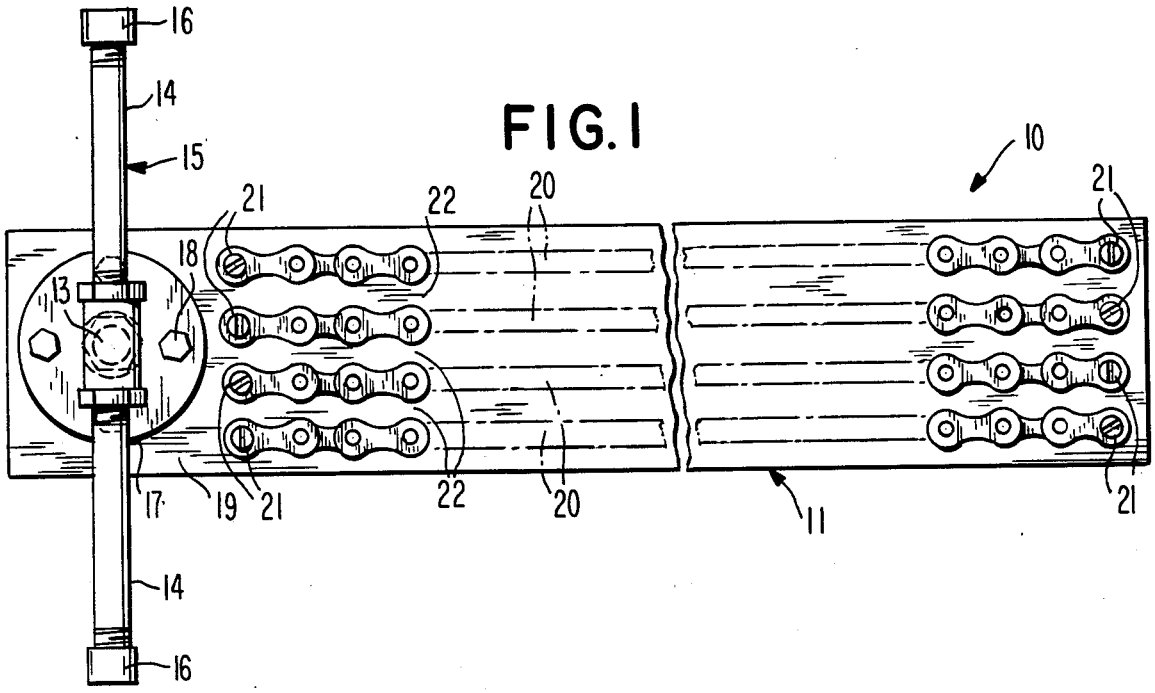
FIG. 1 is a top plan view of a device for cleaning golf shoe spikes, shown in accordance with the present invention.
Figure 2:
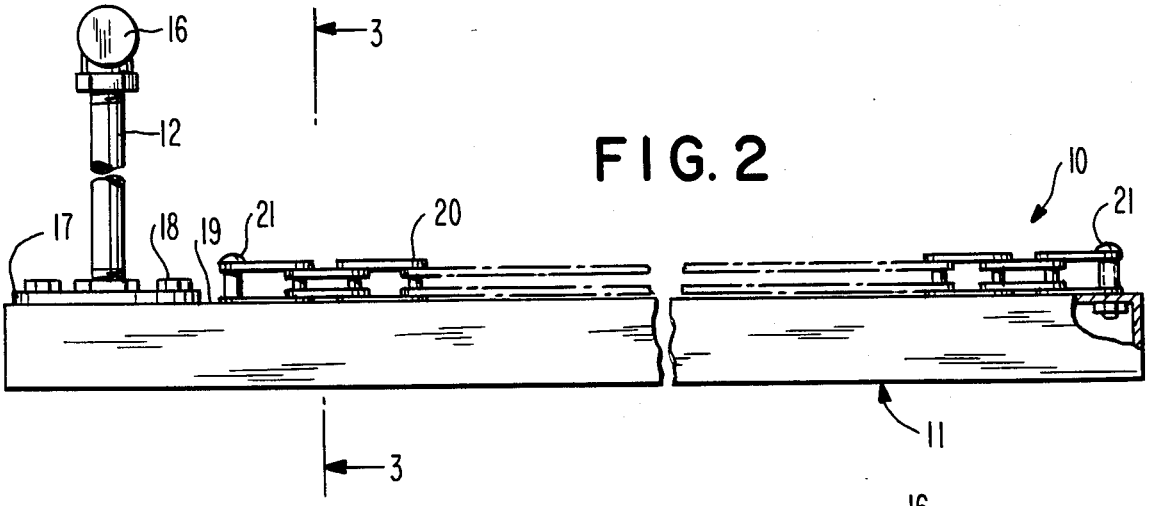
FIG. 2 is a side elevational view of the invention.
Figure 3:
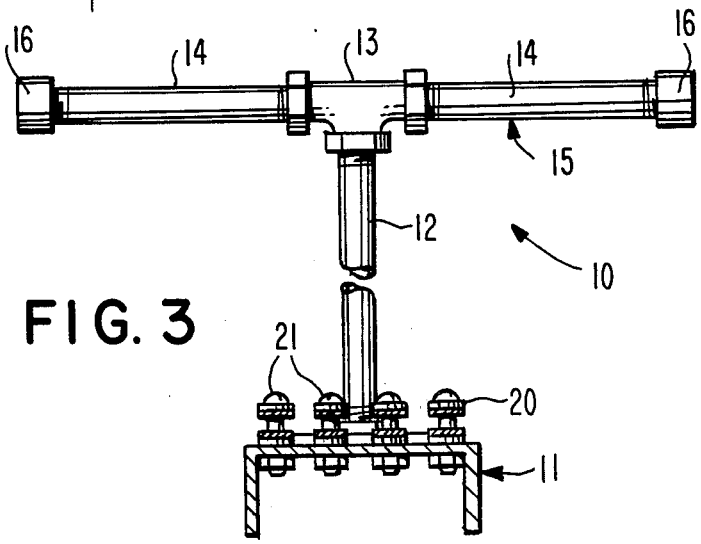
FIG. 3 is a cross-sectional view, taken along the line 3—3 of FIG. 2.

Referring now to the Drawing in greater detail, the reference numeral 10 represents a device for cleaning golf shoe spikes, incorporating the invention wherein there is a base 11, made possibly from a length of channel iron, or the like, and being approximately eighteen inches long for resting horizontally upon the ground. Near one end, a vertical pipe 12 is welded thereupon, and a tee fitting 13 is screwed upon its upper end, and a short pipe 14 is screwed into opposite ends of the fitting, so as to form a horizontal, transverse handle or foot rest 15, when in use. An end cap 16 is screwed on the outer end of each pipe 14. Alternately, instead of welding the pipe 12 upon the base, a conventional fitting 17 may be secured thereto by bolts 18, and the lower end of pipe 12 threaded to the fitting 17.

Upon the remainder of the base top wall 19, a set of four roller chains 20, preferably made of bicycle chains, are secured to the base in straight, parallel, spaced-apart relationship, by means of a bolt 21 through opposite ends of the chains. The chains are the same length, and are fastened so as to be fairly taut, yet with a minimum slack, which is sufficient for only slight sidewardly movement when a shoe is brushed across the top thereof, with the spikes brushing against the sides of the chains, so as to create a "rickety rackety" action against the individual spikes. This action thus wipes partly around the spikes, instead of only contacting them at a single tangential spot. This action cleans the spikes, and also prevents the spaces 22 between the chains from being constantly the same in shape, which, together with the spike sweeping keeps the spaces from becoming clogged with debris.

In use, the shoe may be turned to either sidewardly direction or in straight forwardly rearwardly position during each stroke across the device, as wished.

While various changes may be made in the detail construction, it is understood that such changes will be within the spirit and scope of the present invention as is defined by the appended claims.

What I now claim is:

1. A device for cleaning golf shoe spikes comprising: a base member having a planar upper surface, said base member being adapted to be supported on the ground; an upwardly extending handle member removably attached to one end of said planar upper surface; a plurality of roller chains attached to the planar upper surface, said chains extending the length of said upper surface from said handle member and being spaced apart across said upper surface such that as the golf shoe is moved across said chains the spikes are cleaned between the chains and the spaces between the chains are prevented from being clogged with debris.

* * * * *